United States Patent [19]

Hubele et al.

[11] Patent Number: 4,471,706

[45] Date of Patent: Sep. 18, 1984

[54] DEVICE FOR FEEDING A STRIP OF MATERIAL AND SEWING IT ONTO A CUT OF FABRIC

[75] Inventors: Heinz Hubele, Kaiserslautern; Kurt Petry, Stelzenberg; Werner Striegler, Kaiserslautern, all of Fed. Rep. of Germany

[73] Assignee: Pfaff Industriemaschinen GmbH, Fed. Rep. of Germany

[21] Appl. No.: 568,111

[22] Filed: Jan. 4, 1983

[30] Foreign Application Priority Data

Jan. 15, 1983 [DE] Fed. Rep. of Germany ..... 3301234

[51] Int. Cl.[3] ..... D05B 69/36

[52] U.S. Cl. ..... 112/272; 112/152; 112/276

[58] Field of Search ..... 112/272, 273, 276, 277, 112/152, 153, 130

[56] References Cited

U.S. PATENT DOCUMENTS

| | | | |
|---|---|---|---|
| 3,156,204 | 11/1964 | Harnish et al. | 112/272 X |
| 3,302,600 | 2/1967 | Cheron | 112/272 |
| 3,515,081 | 6/1970 | Miller | 112/152 X |
| 3,999,585 | 8/1971 | Myrick | 112/272 X |

FOREIGN PATENT DOCUMENTS

| | | | |
|---|---|---|---|
| 935947 | 12/1955 | Fed. Rep. of Germany | 112/272 |
| 2448887 | 4/1976 | Fed. Rep. of Germany | 112/272 |

*Primary Examiner*—H. Hampton Hunter
*Attorney, Agent, or Firm*—McGlew and Tuttle

[57] ABSTRACT

A device for feeding a strip of material into a sewing machine so that it can be sewed onto a cut fabric which is fed over a base plate includes a stop which is positionable in the feed path of the strip of material and which control the operation of the sewing machine so that the strip will not be fed unless it is aligned with the associated workpiece and guided past a reciprocating needle.

9 Claims, 1 Drawing Figure

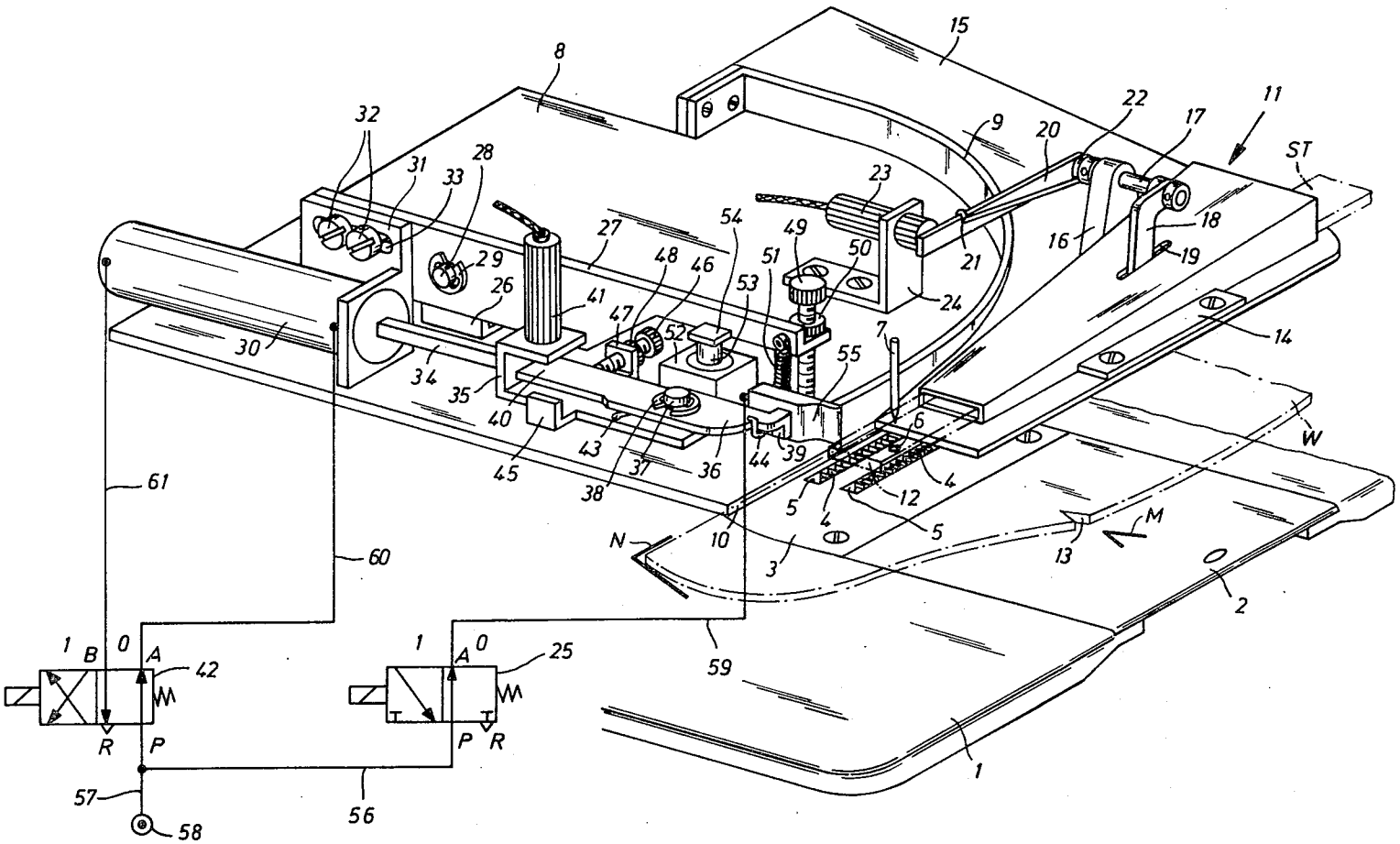
ST
11
14
W
2
17
18
19
22
M
13
20
16
9
21
15
24
1
4
6
5
12
23
50
7
55
4
49
39
5
51
44
3
53
54
36
10
59
46
52
48
37
N
47
27
41
43
38
8
25
45
40
28
29
26
35
A
0
R
P
1
33
34
31
32
60
56
30
42
A
P
58
61
0
R
B
1
57

DEVICE FOR FEEDING A STRIP OF MATERIAL AND SEWING IT ONTO A CUT OF FABRIC

FIELD AND BACKGROUND OF THE INVENTION

This invention relates in general to sewing machines and in particular to a new and useful device for feeding a strip of material into a sewing machine and sewing it into a cut of fabric.

A device similar to the present invention is disclosed in German No. OS 24 48 887. The device is used in the manufacture of trimmed pockets, for simultaneously sewing in a strip of fabric, the so-called flap. To insert the strip of fabric in a position to start the sewing operation exactly at the edge of the strip, the needle stuck into the fabric is used as a stop for the strip. For this purpose, the needle must be brought, after putting the cut of fabric in place and prior to inserting the strip, from its upper position outside the fabric into its stuck-in low position. To eliminate the necessity of a manual intervention, a photocell unit is provided in the needle zone as a means for controlling the switching function of the sewing machine, which cooperates with a reflective surface of an apparatus for guiding the strip of fabric. Upon inserting the strip of fabric into the guide apparatus, the photocell unit responds to actuate a positioner of the sewing machine and move the needle from its upper into its lower position.

The leading edge of the strip of fabric can be displaced to the stop formed by the needle only upon starting the machine to bring the needle into the low position, and stopping it again. This affects a continuous operation.

With soft strips of fabric, the use of the needle as a stop does not show any disadvantage. It become prohibitive however, as soon as relatively stiff strips are involved, such as strips of paperboard, cardboard, plastic or leather, which are employed in the manufacture of automobile seat slipcovers, for example, since then there is a great chance of deforming the needle. Further sewing with a deformed needle not only can easily lead to erroneous stitches causing time losses in changing the needle, threading again, a mending of the seams, but even the rotary hook may get damaged. Further, the needle stuck in the fabric cannot be used as a stop if the seam is to be started with some backstitches under reversed feed, as is required in most instances, since then the stop must be displaced to some extent beneath and beyond the needle in the forward feed direction.

SUMMARY OF THE INVENTION

The invention is directed to a device ensuring a continuous operation, making it possible to sew relatively stiff strips of material, and being insensitive to disturbances.

Upon inserting the cut of fabric in the correct position, the leading edge of the strip of material, which is advanced to the stitch forming area, butts against the stop which has been brought into the feed path of the strip, and displaces it into an end position in which the stop is to be sewed onto the cut of fabric and in which a signal transmitter, such as a control switch of the sequence control for starting the retraction of the stop, the lowering of the presser foot, and the starting of the sewing machine are actuated, so that by a single feed motion the strip is brought into its predetermined end position and the switching processes necessary for starting the sewing operation are released.

In accordance with the invention, a device for feeding a strip of material into the sewing machine and sewing it onto a cut of fabric comprises control means which are actuable by a strip of material to control the switching functions of the sewing machine. The control means includes a stop which may be moved into the feed path of the strip and after being contacted by the strip can be retracted from the feed path. The movement of the stop controls a signal transmitter for a setting means for the stop. The stop is advantageously mounted on a two armed lever which is mounted for being moved and which is biased by a spring. A control cam is in the path of retraction of the stop and the lever can be moved into a position in which the signal transmitter is actuated independently of the strip. The stop is advantageously mounted for being displaced by a setting means in the form of an air cylinder and substantially perpendicularly to the feed motion of the workpiece. The limits of the setting motion of the stop can be adjusted by displaceable stops.

Accordingly, it is an object of the invention to provide a sewing machine which includes a guide chute for a strip of add on material which overlies the bed plate over which a workpiece material is fed. A stop is arranged in the feed path of the strip for contacting and stopping the feeding thereof which is displaceable out of the path and connectable by control means to the sewing machine for controlling the operation of the sewing machine in accordance with the position of the stop and the strip material.

A further object of the invention is to provide a sewing machine control for feeding strip materials to a workpiece which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

BRIEF DESCRIPTION OF THE DRAWING

The only FIGURE of the drawing is a perspective view showing a sewing machine with a bed plate over which material is fed into association with a strip of material constructed in accordance with the invention.

DESCRIPTION OF THE PREFERRED EMBODIMENT

Referring to the drawing, in particular the invention embodied therein comprises a sewing maching which includes a bed plate 1 having a slide 2 on which the workpiece or fabric W is positioned for feeding by feed means including a feed dog 4 into association with a needle 7 which reciprocates upwardly and downwardly. In accordance with the invention a guide apparatus 11 is provided for feeding a strip of material ST which has an opening adjacent the needle out of which the strip of material is fed into association with the workpiece W for sewing by the needle. In accordance with the invention a control setup is arranged which includes a stop in the feed path of the strip ST for contacting the feed path and preventing feed thereof when the strip is not fed in correct association with the fabric W and and it is carried by a doubled arm lever member 36 which is part of a control means including a control switch 41 and a setting means 30 for adjusting the position of the stop.

Of a sewing which is to be equipped with the inventive device, only a few parts are shown, namely the bed plate 1, the slide 2, the needle plate 3, and the legs 4 of a feed dog of the four-motion type, which protrude upwardly through slots 5 provided in needle plate 3, to move the workpiece through the stitch forming area. The thread guiding needle 7 moves downwardly through a needle hole 6, and cooperates with a rotary hook (not shown) to form a seam.

The inventive device comprises a mounting plate 8 which, in a manner known per se, is pivoted to bed plate 1 of the sewing machine. To guide the edge of the cut of fabric W, an arcuate web 9 and a guide edge 10 are provided on mounting plate 8. Upstream of the stitch forming area, a guide apparatus 11 is mounted for guiding a strip of material ST which is cut to a predetermined length and it is to be advanced by its leading edge 12 into a definite position, in the present example; into alignment with a notch 13 provided in cut W, and sewed into the cut W. Guide apparatus 11 is provided with a lateral flange 14 and is screwed to a plate 15 which is conformable to arcuate web 9 and slants toward the stitch forming area so as to leave sufficient space for cut W. Secured to one of the sidewalls of guide apparatus 11 is a supporting bracket 16 for a shaft 17 of a contact arm 18. Contact arm 18 extends through a slot 19 of guide apparatus 11 into the feed path of strip ST. Secured to shaft 17 is a switch arm 20 against which one leg 21 of a torsion spring 22 is applied having its other leg (not shown) bearing against bracket 16. Switch arm 20 operates on a proximity switch 23 which is supported by an angle 24 secured to mounting plate 8 and by which, through the sequence control known per se and comprising a selector switch, a solenoid valve 25 is controlled to start the operation for stopping the sewing machine as soon as strip ST loses contact with contact arm 18 shortly befor the end of the seam, and switch arm 20 moves away from proximity switch 23.

An angle 26 screwed to mounting plate 8 carries a supporting member 27 which is mounted for pivoting about a stud 28 and is secured against axial displacement by a locking washer 29. To one of the ends of supporting member 27, an air cylinder 30 is secured by means of an angle bracket 31 screwed to supporting member 27. To permit adjustment of air cylinder 30, the screws 32 securing angle bracket 31 are passed through an oblong slot 33. A piston rod 34 of air cylinder 30 has a square cross section, to secure it against rotation. To the free end of the piston rod 34, a holder 35 is secured on which a two-armed lever 36 is mounted for pivoting about a pin 37 of the holder 35, and secured by a locking washer 38 against axial displacement. One end of lever 36 is angled downwardly and forms a stop 39 for the leading end 12 of strip ST, which stop can temporarily be moved into the feed path of strip ST. The other end of lever 26 serves as a switch arm 40 for a proximity switch 41 which is supported on holder 35 and by which, through a sequency control known per se, a cylinder valve 42 is controlled to actuate air cylinder 30 and the lowering of the presser foot of the sewing machine, after lever 26 and stop 39 have been pivoted by strip ST into a position in which the strip is to be sewed on.

Two-armed lever 36 is biased by a torsion spring (without reference numeral) having two legs, 43 and 44. Leg 43 is engaged into a bore of the holder 35, and leg 44 bears against stop 39 of lever 36. To limit the pivotal movement of lever 36 in one direction, a fixed stop 45 is provided on holder 35, and a set screw 46 is provided in a lug 47 of holder 35 to limit the movement of lever 36 in the other direction. Set screw 46 can be adjusted by means of a knurled nut. A stop screw 49 settable by a knurled nut 50 is provided for adjusting the position of supporting member 27 and the parts carried thereon, vertically.

A tension spring 31 holds supporting member 27 and stop screw 49 in contact with mounting plate 8. Supporting member 27 can be pivoted about stud 28 and against the action of tension spring 51 by means of a single-action air cylinder 52 having its piston rod 53 spring biased and applying against a projection 54 of supporting member 27.

In the path of motion of stop 39, a cam 55 is provided through which lever 36 during its return into the shown rest position actuates proximity switch 41, independently of strip ST.

The pump connections P of solenoid valves 25 and 42 are connected by flexible lines 56,57 to a compressed air source 58. The operating connection A of solenoid valve 25 is connected through a flexible line 59 to air cylinder 52, while the operating connection A of solenoid valve 42 is connected through flexible line 60 to one side, and through a flexible line 61 to the other side of double-acting air cylinder 30.

The device operates as follows:

As soon as the trailing edge of strip ST has lost contact with contact arm 18 shortly before the end of the respective sewing operation, contact arm is turned under the action of spring 22, switch arm 20 is moved away from proximity switch 23, and a sequence control is thereby started to switch off solenoid valve 25 and start the final locking operation and stopping the sewing machine, with the following cutting of the thread, lifting the presser foot, and actuating solenoid valve 42. The workpiece can then be removed.

Upon switching off solenoid valve 25, compressed air is supplied through operating connection A and flexible line 59 to air cylinder 52, so that supporting member 27 is lifted at the side of stop screw 49, aginst the action of tension spring 51. Upon switching on solenoid valve 42, one side of air cylinder 30 is vented through flexible line 60 and connection A and R and the other side is supplied through pump connection P and operating connection B of solenoid valve 42 and flexible line 61 so that piston rod 34 which is connected to the working piston displaces holder 35 with lever 36 to the stitch forming area, and stop 39 comes into the feed path of strip ST. During this motion, stop 39, under the action of torsion spring 43/44, follows the curved surface of control cam 55, so that switch arm 40 moves away from proximity switch 41.

Since presser foot of the sewing machine and stop 39 are still lifted, a new cut of fabric W can be introduced below plate 15, with the lateral edge applied against web 9 and guide edge 10 and notch 13 being aligned with a mark on slide 2 and the leading corner being aligned with a mark N on bed plate 1. Then, a strip of material ST is fed through guide apparatus 11 into the stitch forming area, until leading edge 12 comes beyond needle 7. Strip ST thus lifts contact arm 18 and causes lifting of switch arm 20, so that proximity switch 23 is actuated to deliver a control signal to solenoid valve 25 which switches into its postion 1 in which air cylinder 52 is vented through line 59 and connections A and R, wherefore member 27 is moved downwardly under the action of spring 51 and stop screw 49 is pulled into contact with mounting plate 8. In this position, stop 39 applies against cut W in a position in front of the mount of guide apparatus 11.

During the further feed motion, leading edge 12 of strip ST butts against stop 39 thereby causing pivoting of lever 36 and of switch arm 40 against the action of torsion spring 43/44 about pin 37, into contact with stop screw 46 by which the end position of stop 39 and thus the sewing position of strip ST is determined. In the end phase of the pivotal motion, proximity switch 41 is actuated whereby first solenoid valve 42 is switched off, so that air cylinder 30 is vented through line 61 and connections P and R of the solenoid valve, and the air cylinder 30 is supplied with compressed air through connection P and A of solenoid valve 42 and line 60. Thereby, through piston rod 34 connected to the working piston of air cylinder 30, holder 35 with lever 36 are returned to their rest positions and stop 39 is retracted from the feed path of strip ST.

During this retraction, lever 36 is pivoted by spring 43/44 to apply stop 39 to the curved surface of control cam 55, and moves switch arm 40 away from proximity switch 41. A sequence control of the sewing machine is thereby started by which presser foot is lowered as soon as stop 39 has left the contact area of the presser foot and after a short delay, the sewing machine is started again to perform the sewing operation beginning with some back stitches for locking the seam.

During the further reverse motion, stop 39 follows the curved surface of control cam 55, and lever 36 is pivoted again into the shown position in which switch arm 30 opposes proximity switch 41.

As mentioned above, in connection with the operation of the device, the switching processes for stopping the sewing operation are released by contact arm 18 as soon as the trailing edge of strip ST passes by.

While a specific embodiment of the invention has been shown and described in detail to illustrate the application of the principles of the invention, it will be understood that the invention may be embodied otherwise without departing from such principles.

What is claimed is:

1. A device for feeding a strip of material into a sewing machine and sewing it onto a cut of fabric, comprising control means actuable by the strip of material to control switching functions of the sewing machine, said control means including a stop which is movable into and out of the feed path of the strip, said stop being contactable by the strip and being retractable from the feed path, setting means connected to the stop for moving said stop and positioning it in respect to the strip in a signal transmitter connected to said setting means for actuating the sewing machine and said stop.

2. A device according to claim 1, including a two armed lever having a portion forming said stop mounted adjacent said needle for pivotal movement, spring means biasing said lever in a first direction, a control cam overlying said bed plate in a position adjacent said needle located in the path of retraction of said stop for controlling the retraction movement thereof, said lever being moved into a position in which said signal transmitter is actuated independently of the strip.

3. A device according to claim 2, wherein said stop is mounted for being displaced by said setting means substantially perpendicular to the feed motion of the workpiece, and a second setting means connected to said stop for moving it in a vertical direction.

4. A device according to claim 2, including first and second fixed stops located adjacent said stop for limiting the movement thereof.

5. In a sewing machine including a bed plate over which a workpiece material is fed past a reciprocating thread needle, the improvement comprising a guide chute for a strip of add-on material overlying the bed plate and having an opening for the strip of material adjacent the needle for feeding the strip over the workpiece, a stop in the feed path of the strip for contacting and stopping the feed thereof and being movable out of the feed path of said strip to permit the feeding thereof with the workpiece, and control means associated with said stop and including a member movable with said stop and connectable to the sewing machine for controlling the operation of the sewing in accordance with the position of said stop.

6. A sewing machine according to cliam 5, including sensor means associated with said chute for sensing the presence of the strip.

7. A sewing machine according to claim 5, including an arcuate web guide for the workpiece overlying said bed plate and a straight guide extending from said arcuate guide away from the needle.

8. In a sewing machine according to claim 5, wherein said movable member comprises a double arm control lever which is movable with said stop off the strip, said transmitter including a switch actuated by said control arm, said control means including an actuated air cylinder connected to said stop for displacing said stop and a cylinder valve connected to said solenoid valve for moving the stop position in which the workpiece can be removed, a fluid pressure cylinder, the fluid pressure cylinder, the control piston movable in said cylinder, a support for said air cylinder setting means displaceable by said control piston.

9. In a sewing machine according to claim 8, including a cam located along said side said stop, said stop being movable over said cam.

* * * * *